US008231368B2

(12) United States Patent
Bae et al.

(10) Patent No.: US 8,231,368 B2
(45) Date of Patent: Jul. 31, 2012

(54) MULTI-STAGE ROTARY COMPRESSOR

(75) Inventors: Young-Ju Bae, Gyeongsangnam-do (KR); Seung-Jun Lee, Gyeongsangnam-do (KR); Joon-Hong Park, Busan (KR); Kang-Wook Cha, Gyeongsangnam-do (KR); Seung-Mun An, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 12/893,191

(22) Filed: Sep. 29, 2010

(65) Prior Publication Data

US 2011/0020148 A1 Jan. 27, 2011

Related U.S. Application Data

(62) Division of application No. 11/793,152, filed on Mar. 26, 2008, now abandoned.

(51) Int. Cl.
*F03C 2/00* (2006.01)
*F03C 4/00* (2006.01)
*F04C 11/00* (2006.01)

(52) U.S. Cl. ..... 418/11; 418/60; 418/212; 418/270

(58) Field of Classification Search ..... 418/11, 418/60, 63, 212, 270
See application file for complete search history.

(56) References Cited

U.S. PATENT DOCUMENTS

| | | | | |
|---|---|---|---|---|
| 5,242,280 | A | 9/1993 | Fujio | |
| 6,318,981 | B1 | 11/2001 | Ebara et al. | |
| 6,651,458 | B1 | 11/2003 | Ebara et al. | |
| 6,907,746 | B2 | 6/2005 | Sato et al. | |
| 2003/0172666 | A1 * | 9/2003 | Matsumoto et al. | 62/175 |

FOREIGN PATENT DOCUMENTS

| | | |
|---|---|---|
| CN | 1371453 | 9/2002 |
| EP | 1209361 | 5/2002 |
| EP | 1418338 | 5/2004 |

* cited by examiner

*Primary Examiner* — Theresa Trieu
(74) *Attorney, Agent, or Firm* — McKenna Long & Aldridge LLP

(57) ABSTRACT

A multi-stage rotary compressor comprises: a casing having a sealed space therein; a driving unit installed in the casing, for generating a driving force; a first compression unit and a second compression unit for receiving the driving force from the driving unit and compressing a refrigerant; and a connection unit for connecting the first and second compression units and guiding the refrigerant discharged from the second compression unit to be sucked directly in the first compression unit and then re-compressed, by which it is possible to vary capacity, even using every plurality of compression units, and to obtain power saving effect suitable for a saving mode.

8 Claims, 5 Drawing Sheets

MULTI-STAGE ROTARY COMPRESSOR

This application is a Divisional Application of National Phase application Ser. No. 11/793,152, filed Mar. 26, 2008, now abandoned, which claims the benefit of PCT/KR2004/003290, filed 14 Dec. 2004, all of which is are hereby incorporated by reference for all purposes as if fully set forth herein.

FIELD OF THE INVENTION

The present invention relates to a rotary compressor which is compressed in a multi-stage, and more particularly, to a multi-stage rotary compressor capable of optimizing compression efficiency, using a plurality of compression units all together.

DISCUSSION OF THE RELATED ART

A compressor is a device for compressing an operation gas and thus enhancing pressure by receiving power from a power generator such as an electric motor and compressing air, a refrigerant gas or other specific gas, which has been being used throughout industries. The compressor may be divided into a positive displacement compressor and a turbo compressor according to how to compress. The positive displacement compressor has a compressing method in which pressure is increased by decreasing volume, while the turbo compressor achieves a compression by converting a kinetic energy of a gas into a pressing energy. A rotary compressor, one of the positive displacement compressor, is generally applied to an air conditioning apparatus such as an air-conditioner. Recently, it is the trend that the air-conditioner has various functions. In response, the rotary compressor requires a product capable of varying capacity thereof.

The rotary compressor has used a refrigerant containing a CFC-based chlorine. However, the refrigerant is known to destroy the earth's ozone layer, which causes a global warming. As a result, its use is legally regulated and extensive researches have been made for an alternative refrigerant with respect to the existing refrigerant. Carbon dioxide is expected as the alternative refrigerant. Moreover, the global warming is led to a problem of improvement of an energy efficiency of instruments as well as a problem of the alternative of the refrigerant. This is because the carbon dioxide occurred by burning fossil fuel (a great deal of electric energy is still obtained by burning the fossil fuel) is the chief culprit of the global warming.

Accordingly, in the compressor which corresponds to the core part of a refrigeration system, it is the most considerable matter how to applying alternative refrigerants harmless for a global environment to the existing compressor without loss of performance thereof.

There is a multi-stage rotary compressor having a plurality of compression units capable of varying capacity thereof and of using an alternative refrigerant.

A typical multi-stage rotary compressor has a plurality of compression units for sucking, compressing and discharging a refrigerant, respectively; and a driving unit for driving the compression units, all of which are accommodated in a sealed container.

In the compression unit, a plurality of eccentric cams are integrally formed at a rotating shaft rotated by the driving unit. A rolling piston is fit-fixed to an outer circumferential surface of each eccentric cam. The rolling piston is positioned in a cylinder and rolledly-moved when it is contact with an inside diameter of the cylinder. The cylinder is divided therein into a suction chamber and a compression chamber by a vane contacting the rolling piston. The driving unit is composed of a motor for rotating the rotating axis, and accommodated in the sealed container together with the compression unit.

This typical multi-stage rotary compressor sequentially performs suction, compression and discharge of a refrigerant when the rolling piston is contact with the inside diameter of the cylinder at one point. If respective compression units are driven, a great deal of load is generated thereby to obtain a great capacity (hereinafter, referred to a power mode). At this time, the capacity of the compressor may correspond to the sum of refrigerants discharged from the respective compression units. If it is expected that the load is decreased thereby to obtain less capacity and power saving effect (hereinafter, referred to a saving mode), it may be achieved by cutting off the refrigerants sucked in several compression units, or by idling the rolling piston without allowing the compression of the refrigerant by means of moving the vane back and fixing it with such as a piece thereby to remove a boundary between the suction chamber and the compression chamber.

Or, the capacity of the refrigerant may be varied by speed variation using an inverter motor having a control drive as a driving unit.

The structure of the typical rotary compressor and a driving method therefor have the following problems.

First, in case of cutting off a refrigerant sucked in the compression unit, various capacity variation may not be implemented.

Second, during the saving mode in process, the method of moving back and fixing the vane requires an additional component like the piece and a space to install it, and increases the number of manufacturing processes.

Third, as the piece repeatedly impacts on the vane, it may result in damaging a surface thereof as the time elapses, and cause abrasion or generation of impurity thereby to degrade reliability of the compressor.

Fourth, in cases of idling the rolling piston or cutting off a suction of the refrigerant, because several compression units are not used, it may degrade efficiency of the compressor.

Fifth, in case of using the inverter motor as the driving unit, it requires generally a high price so as to increase manufacturing costs. Therefore, there is a need for realizing a capacity variation even using a constant-seed motor which requires relatively low price.

DISCLOSURE OF THE INVENTION

Technical Problem

Therefore, it is an object of the present invention to provide a multi-stage rotary compressor capable of maximizing a compression efficiency, even using a plurality of compression units al together, and of decreasing power consumption to be suitable for a saving mode.

Technical Solution

To achieve these objects, there is provided a multi-stage rotary compressor, comprising: a casing having a sealed space therein; a driving unit installed in the casing, for generating a driving force; a plurality of compression units for receiving the driving force from the driving unit and compressing a refrigerant; and a connection unit for connecting the plurality of compression units and guiding the refrigerant discharged from a compression unit to be sucked directly into the neighboring compression unit and then to be re-compressed.

BEST MODE

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Hereinafter, it will be described about a multi-stage rotary compressor according to the present invention with reference to the accompanying drawings.

Figure 1:
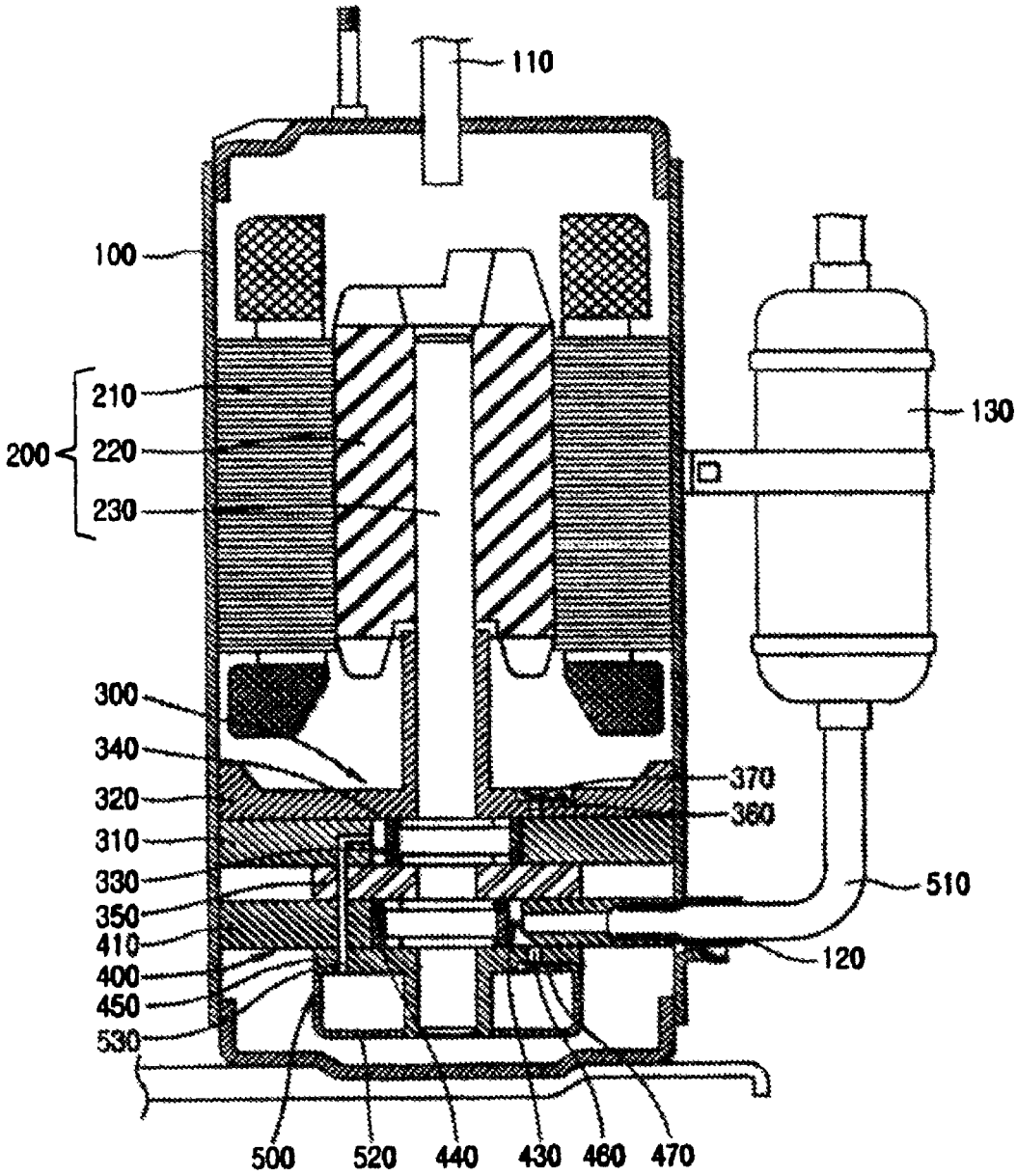
FIG. 1 is a sectional view showing a first embodiment in accordance with the present invention.

FIG. 1 is a sectional view showing a first embodiment of a multi-stage rotary compressor in accordance with the present invention.

As can be seen from FIG. 1, the multi-stage rotary compressor according to the present invention includes: a casing 100 having a sealed space therein; a driving unit 200 installed in the casing 100, for generating a driving force; two compression units 300 and 400 connected to the driving unit 200, for compressing a refrigerant; a connection unit 500 for connecting the two compression units 300 and 400 to each other and guiding the refrigerant discharged from the second compression unit 400 to be sucked directly in the first compression unit 300 and re-compressed.

The casing 100 is formed to penetrate a discharge pipe 110 and a second suction pipe 510.

The driving unit 200 includes: a stator 210 fixed in the casing 100, for applying power from the external; a rotator 220 set in the stator 210 having a certain pore and rotated, interacting with the stator 210; and a rotating axis 230 integrally formed with the rotator 220, for transferring the driving force to the compression units 300 and 400 and having two eccentric portions.

The driving unit 200 is preferably formed as a constant-speed motor. In general, the constant-speed motor is advantageously cheaper than an inverter motor having a control drive.

The compression unit is formed with the first compression unit 300 and the second compression unit 400. The first compression unit 300 includes: a first cylinder 310 formed in a ring shape and installed in the casing 100; an upper bearing 320 and a middle bearing 350 covering both upper and lower sides of the first cylinder 310 to form a first inner space 330 and supporting the rotating axis 230 in a direction of a semidiameter thereof; a first rolling piston 340 inserted in an upper eccentric portion of the rotating axis 230, for rotating in the first inner space 330 of the first cylinder 310 and compressing a refrigerant; a first vane (not shown) movably-coupled to the first cylinder 310 in a direction of a semidiameter thereof to be welded with a pressure at an outer circumferential surface of the first rolling piston 340, for dividing the first inner space 330 of the first cylinder 310 into a first suction chamber and a first compression chamber; and a first discharge valve 370 coupled (to be opened/closed) to an upper end of a first discharge hole 360 formed at the upper bearing 320 to be communicated with the first compression chamber, for adjusting a discharge of the refrigerant discharged from the first compression chamber.

The second compression unit 400 includes: a second cylinder formed in a ring shape, positioned at a lower side of the first cylinder 310 and come in contact with the middle bearing 350; a lower bearing 450 coupled to an upper surface of the second cylinder 410, for forming a second inner space 430 therewith and supporting the rotating axis 230 in a direction of semidiameter and in a axial direction; a second rolling piston 440 rotatably-coupled to a lower eccentric portion of the rotating axis 230 and positioned at the second inner space 430 of the second cylinder 410, for compressing a refrigerant; a second vane (not shown) rotatably-coupled to the second cylinder 410 in a direction of a semidiameter thereof to be welded with a pressure at an outer circumferential surface of the second rolling piston 440, for dividing the second inner space 430 of the second cylinder 410 into a second suction chamber and a second compression chamber, respectively; and a second discharge valve 470 coupled (to be opened/closed) to an upper end of a second discharge hole 460 formed at one side of the lower bearing 450 to be communicated with the second compression chamber. There is only the one second compression unit at which the refrigerant is first compressed but there can be formed a plurality of the first compression units for the re-compression of the refrigerant.

A volume of the first inner space 330 of the first cylinder 310 can be formed to be equal to that of the second inner space 430 of the second cylinder 410. However, in order to vary a capacity more precisely, the volumes of the first and second inner spaces 330 and 430 should be preferably formed to be different from each other, which will be later described with reference to FIG. 7.

The connection unit 500 includes: a second suction pipe 510 for guiding a refrigerant to the second compression unit 400; a chamber 520 for covering the second discharge valve 470 of the second compression unit 400 and then temporally storing the refrigerant discharged from the second compression unit 400; and a first connection passage 530 for guiding the refrigerant from the chamber 520 to the first compression unit 300.

A suction side of the second suction pipe 510 is connected to an accumulator 130 which separates gas-liquid of the refrigerant.

The chamber 520 is installed at a lower portion of the second compression unit 400 (more precisely, at a lower portion of the lower bearing 450) in order to prevent a leakage of the refrigerant with maintaining its sealed state. The chamber 520 can also perform a function as a muffler for reducing noise during the operation of the compressor.

The first connection passage 530 sequentially penetrates the lower bearing 450, the second cylinder 410 and the middle bearing 450 in an axial direction thereafter to be extended in a direction of a semidiameter of the first cylinder 310 and thereby is connected to the first inner space 330 of the first cylinder 310.

The first connection passage 530, likely in the preferred embodiment, can be formed in the bearing and the cylinder but exposed out of the compressor by configuring a part thereof with such a pipe. For instance, the pipe connected to the chamber 520 penetrates the casing 100 thereby to be partially exposed to the outside and then again penetrates a side surface of the casing 100 and the first cylinder 310 in a direction of a semidiameter thereafter to be connected to the first inner space 330 of the first cylinder 310.

Now, it will be explained of an operation effect of the multi-stage rotary compressor according to the present invention.

Once applying power to the driving unit 200, the rotating axis 230 is rotated and the first rolling piston 340 and the second rolling piston 440 encircle at the inner spaces 330 and 430 of each cylinder. While this, a volume is formed between the first vane (not shown) and the second vane (not shown) thereby to suck a refrigerant. The refrigerant passed through the accumulator 130 is sucked into the second compression unit 400 through the second suction pipe 510 and compressed. Then, the compressed refrigerant passes through the second discharge hole 460 and is discharged into the chamber 520. The refrigerant discharged into the chamber 520 is sucked into the first compression unit 300 through the first connection passage 530 and then re-compressed. The re-compressed refrigerant is discharged into the casing 100 through the first discharge hole 360 and guided to the outside of the compressor through the discharge pipe 110.

That is, the compression units are serially connected to each other so that the refrigerant sequentially passes through the second compression unit 400 and the first compression unit 300 thereby to meet the discharge pressure. In order to obtain a proper level of the discharge pressure, two-stage compressing process is performed, and more particularly, because the first compression unit sucks a refrigerant somewhat compressed by the second compression unit 400, power requirement is not much.

Furthermore, in the present invention, because the previously-compressed refrigerant is re-compressed, a high discharge pressure can be achieved and a volume efficiency can be improved as well. Additionally, because the previously-compressed refrigerant is used during the re-compression in process, a leakage of the refrigerant into the casing can be reduced and heat quantity transferred to a low temperature refrigerant of the suction side can be substantially decreased as well. Moreover, in the present invention, compared with the method in which a vane is moved back and fixed during a saving mode, an additional component and a space to install it are not required and the manufacturing process therefor is simple. Because a piece to move back and fix the vane is not required, there may not occur problems such as abrasion and a generation of impurity so as to improve reliability of the compressor.

Figure 2:
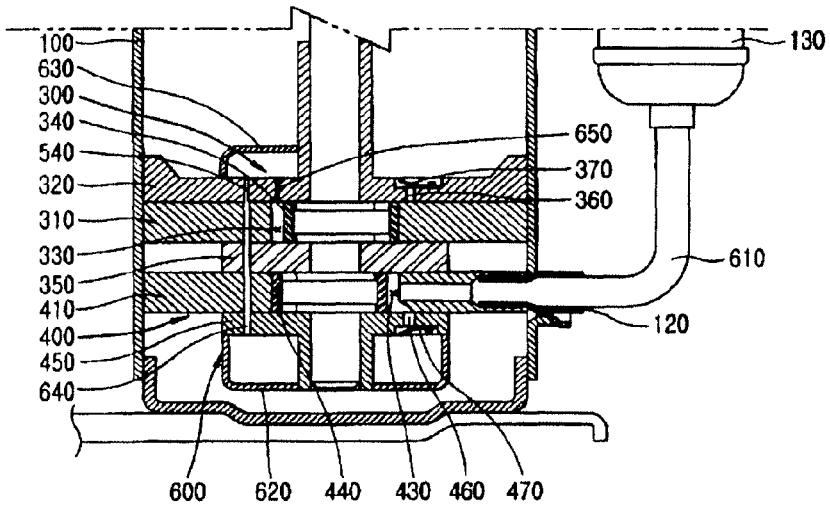
FIG. 2 is a sectional view showing a second embodiment in accordance with the present invention.

FIG. 2 is a sectional view showing a second embodiment according to the present invention. Hereinafter, it will be omitted for an explanation of the same structure or operation to the first embodiment.

As shown in FIG. 2, a connection unit 600 includes: a second suction pipe 610 for guiding a refrigerant to the second compression unit 400; a first chamber 620 for covering the second discharge valve 470 of the second compression unit 400 and then temporally storing the refrigerant discharged from the second compression unit 400; a second chamber 630 for receiving the refrigerant from the first chamber 620 and temporally storing it; a first connection passage 640 for guiding the refrigerant from the first chamber 620 to the second chamber 630; and a second connection passage 650 for guiding the refrigerant from the second chamber 630 to the first compression unit 300.

The first chamber 620 is installed at a lower portion of the second compression unit 400 (more precisely, at a lower portion of the lower bearing 450) in order to prevent a leakage of the refrigerant with maintaining its sealed state.

The second chamber 630 is installed at an upper portion of the first compression unit 300 (more precisely, at an upper portion of the upper bearing 320) for preventing a leakage of the refrigerant.

The first connection passage 640 penetrates the bearings 320, 350 and 450 and the first and second cylinder 310 and 320 in an axial direction and then is communicated with the first chamber 620 and the second chamber 630.

The second connection passage 650 penetrates the upper bearing 320 and thereby connects the second chamber 630 and the second inner space 430 of the second cylinder 410.

The second embodiment of the present invention is operated similar to the first embodiment but there can be differences from each other which will be described as follows.

The refrigerant discharged from the second compression unit 400 into the first chamber 620 is moved into the second chamber 630 through the first connection passage 640, and then guided to the inner space 330 of the first compression unit 300 via the second compression passage 650. In the embodiment, as the two chambers 620 and 630 are used, a muffler function is enhanced thereby to reduce noise during an operation of the compressor.

Figure 3:
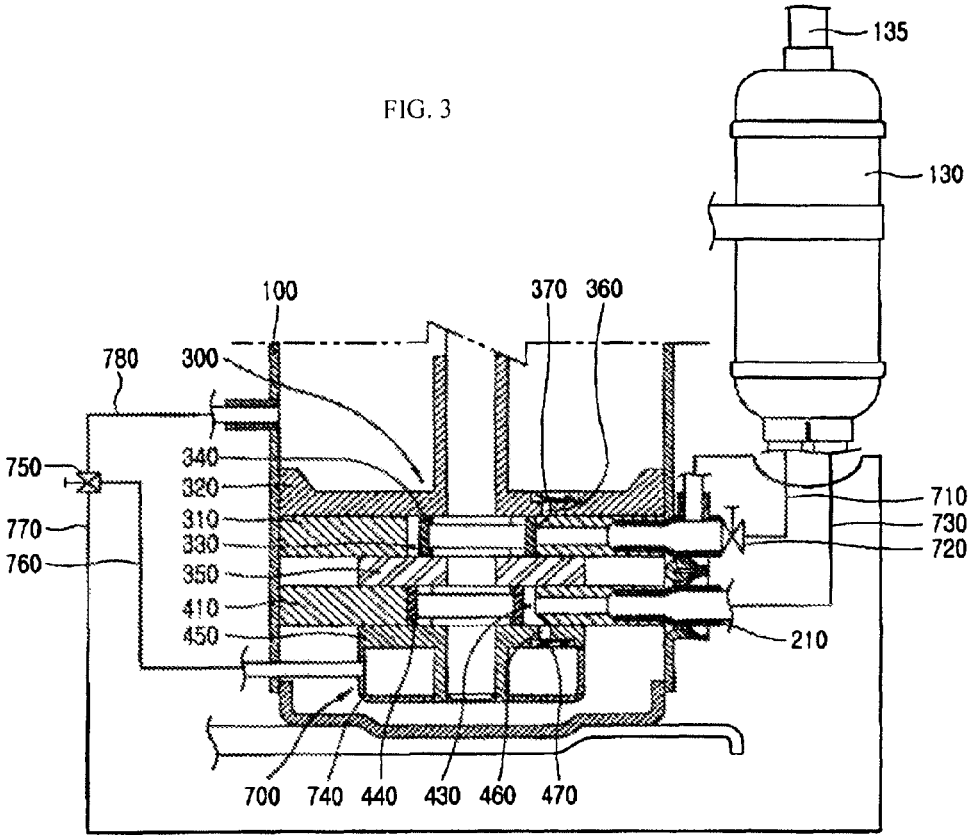
FIG. 3 is a sectional view showing a third embodiment in accordance with the present invention.

FIG. 3 is a sectional view showing a third embodiment according to the present invention.

Referring to FIG. 3, a connection unit 700 connects the two compression units 300 and 400 in parallel so as to suck and compress the refrigerant at each compression unit 300 and 400 and then discharge it. Also, the connection unit 700 selectively connects the two compression units 300 and 400 in series for guiding the refrigerant discharged from the first compression unit 300 to be sucked directly into the second compression unit 400 and then compressed.

The casing 100 communicates the discharge pipe and two suction pipes 710 and 730, and is communicated with a third connection pipe 780 at its one side, of which will be later explained.

The connection unit 700 includes: the first suction pipe for guiding the refrigerant to the first compression unit 300; a first control valve 720 mounted on the first suction pipe 710, for controlling a sucked refrigerant; the second suction pipe 730 for guiding the refrigerant to the second compression unit 400; a chamber 740 for covering the second discharge valve 470, which controls a discharged refrigerant from the second compression unit 400, and temporally storing the refrigerant discharged from the second compression unit 400; a second control valve 750 for adjusting a flow direction of the refrigerant; a first connection pipe 760 for connecting the chamber 740 to the second control valve 750; a second connection pipe 770 for connecting the second control valve 750 to the first connection pipe 760 and guiding the refrigerant to the first compression unit 300; and a third connection pipe 780 for connecting the second control valve 750 to the casing 100 and guiding the refrigerant to an inner space of the casing 100.

Suction sides of the first suction pipe 710 and the second suction pipe 730 are connected to the accumulator 130 which separates the gas-liquid of the refrigerant. After separating the gas-liquid from an accumulator pipe 135 which receives the refrigerant from the external, the accumulator 130 sends out only a gas component through the first suction pipe 710 and the second suction pipe 730. One of the first and second suction pipes may not pass through the accumulator 130 but be directly connected to a compression unit. FIG. 3 is the sectional view showing this embodiment.

The chamber 740 is installed at a lower portion of the second compression unit 400 (more precisely, at a lower portion of the lower bearing 450) for maintaining its sealed state in order to prevent a leakage of the refrigerant. The chamber 740, on the other hand, is connected to the second control valve 750 through the second connection pipe 770. The chamber 740 can also performs a function as a muffler in order to reduce noise during an operation of the compressor.

The first control valve 720, as a 2-way valve, can be formed as an opening/closing valve capable of controlling a passage of the refrigerant.

The second control valve 750, as a 3-way valve, can be formed as a pilot valve which communicates the first connection pipe 760 and the second connection pipe 770, or the first connection pipe 760 and the third connection pipe 780 by a control.

Figure 4:
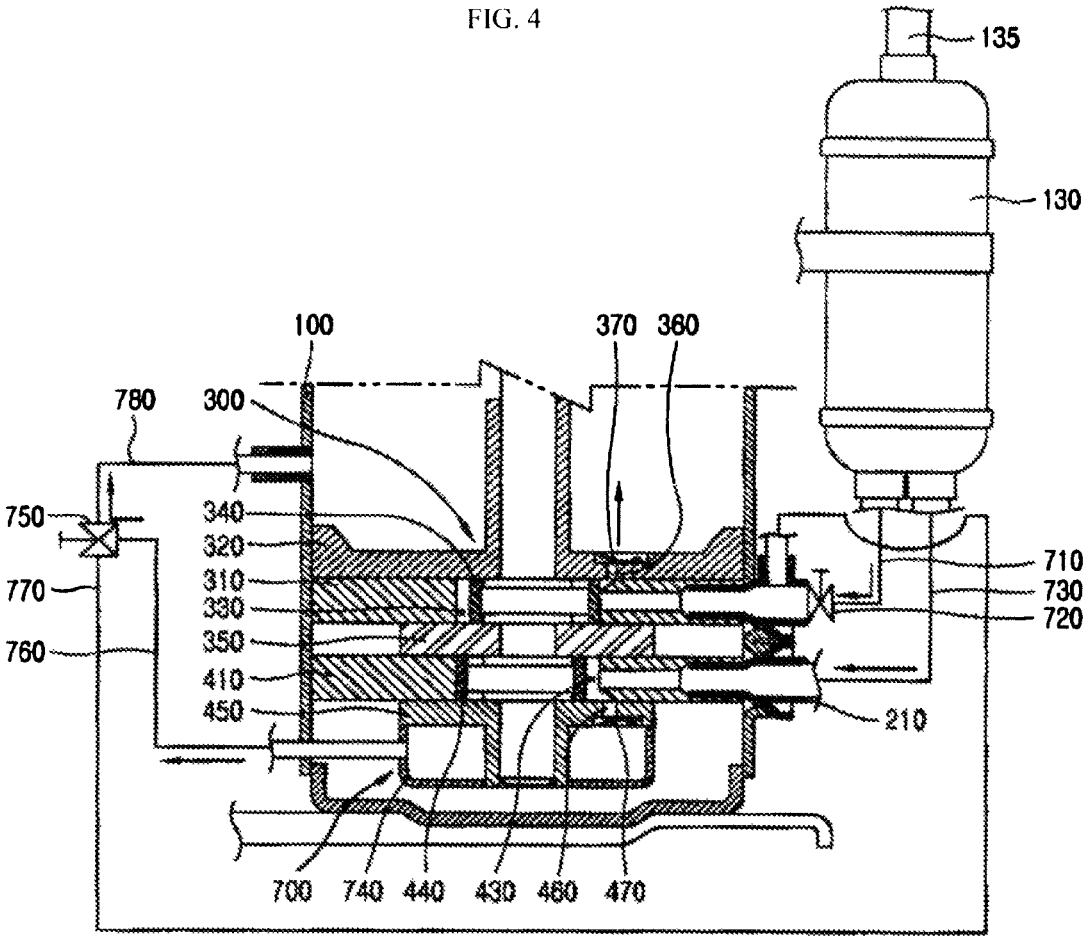
FIG. 4 is a sectional view showing an operation of a power mode in accordance with the third embodiment of the present invention.

As stated above, the multi-stage rotary compressor according to the present invention is operated as follows. FIG. 4 is a sectional view showing an operation of the multi-stage rotary compressor during a power mode in accordance with a third embodiment of the present invention.

Referring to FIG. 4, first explaining the case of a power mode which requires a great deal of refrigerants in process, a sucked refrigerant flows into the first compression unit 300 by turning on the first control valve 720. At the same time to this, the first connection pipe 760 is communicated with the third connection pipe 780 by controlling the second control valve 750. At this time, the refrigerant should not flow toward the second connection pipe 770.

Once applying power to the driving unit 200, the rotating axis 230 is rotated and the first rolling piston 340 and the second rolling piston 440 encircle at the inner spaces 330 and 430 of each cylinder. While this, a volume is formed between the first vane (not shown) and the second vane (not shown) thereby to suck the refrigerant. A part of refrigerant having passed through the accumulator 130 is sucked into the first compression unit 300 through the first suction pipe 710 and compressed, thereafter being discharged into the casing 100 through the first discharge hole 360. The remaining refrigerant having passed through the accumulator 130 is sucked into the second compression unit 400 through the second suction pipe 730 and compressed, thereafter being discharged into the chamber 740 through the second discharge hole 460. The refrigerant discharged into the chamber 740 is then discharged into the casing 100 via the first connection pipe 760, the second control valve 750 and the third connection pipe 780 in sequence. The refrigerant discharged from the first compression unit 300 and the second compression unit 400, respectively, makes the inside of the casing 100 satuated and is discharged out of the casing 100 through the discharge pipe, of which processes are repeated.

Accordingly, during a power mode in process, the first and second compression units are connected in parallel so that the refrigerant is compressed and discharged in each compression unit. Thereafter, the refrigerant is gathered in the casing 100 and then moved out of the compressor through the discharge pipe. As a result, a discharged amount of the refrigerant is greater than that in a saving mode, which will be explained as below.

Figure 5:
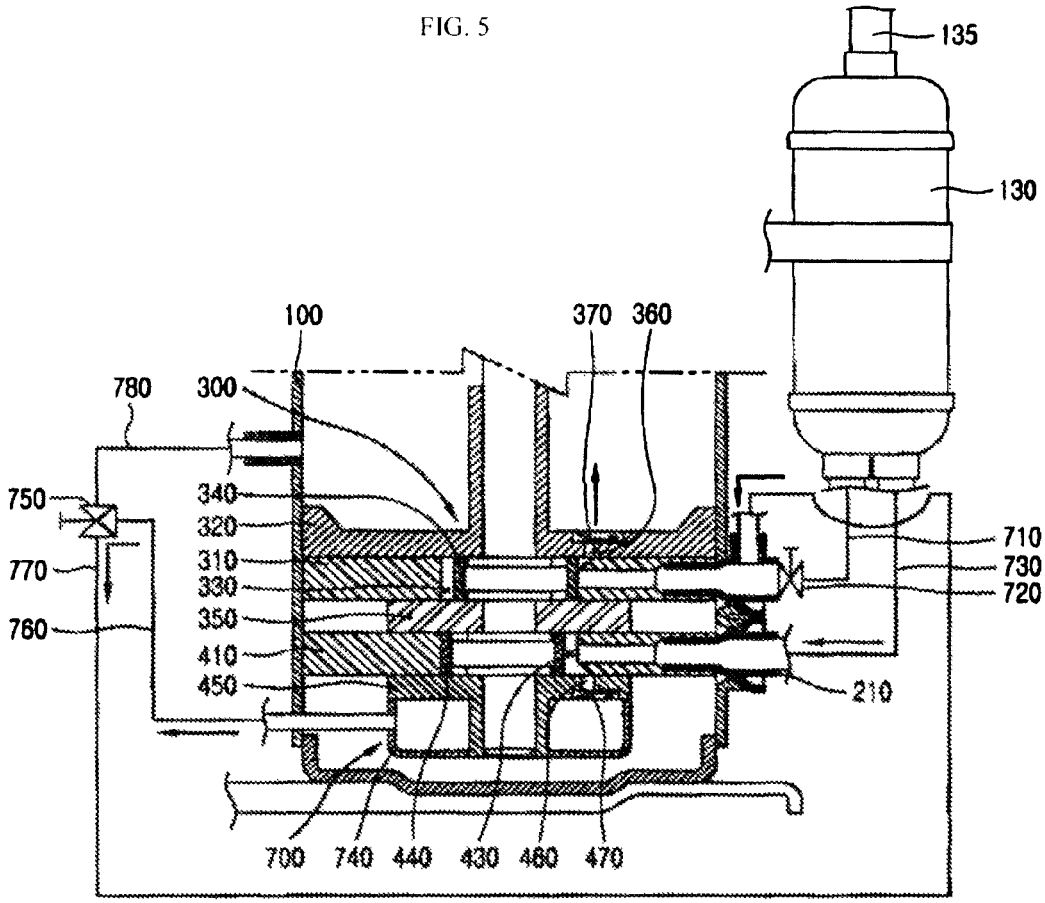
FIG. 5 is a sectional view showing an operation of a saving mode in accordance with the third embodiment of the present invention.

Now, it will be explained of the saving mode which requires a less amount of refrigerant with reference to FIG. 5.

A sucked refrigerant having passed through the accumulator 130 is prevented from flowing into the first compression unit 300 by turning on the first control valve 720. At the same time to this, the first connection pipe 760 is communicated with the second connection pipe 770 by controlling the second control valve 750. The whole refrigerant having passed through the accumulator 130 is sucked into the second compression unit 400 through the second suction pipe 730 and compressed, thereafter being discharged into the chamber 740 through the second discharge hole 460. The refrigerant temporally stored in the chamber 740 is sucked into the first compression unit 300 via the first connection pipe 760, the second control valve 750 and the second connection pipe 770 in sequence and then re-compressed. The re-compressed refrigerant is discharged into the casing 100 through the first discharge hole 360 and then guided to an external refrigeration system through the discharge pipe.

As stated above, during the saving mode in process, the refrigerant having compressed in the second compression unit 400 is moved into the first compression unit 300 to be re-compressed. That is, the compression unit are connected in series so that the refrigerant is discharged via the second compression unit 400 and the first compression unit 300 in sequence, which leads to a relatively small discharged amount of the refrigerant and a high compression rate. Additionally, in order to an appropriate level of discharge pressure, there are performed two-step compression processes. In particular, since the first compression unit 300 sucks the refrigerant somewhat compressed by the second compression unit 400, power requirement becomes less. During the saving mode in process, since the sum of the power requirement of the first and second compression units is not greater than that during a power mode in process, a power saving effect can be achieved.

Moreover, in the present invention, the control unit is installed therein so that a relatively low price of a constant-speed motor is used rather than using a high price of an inverter motor, which results in realizing a capacity variation by implementing a power mode and a saving mode and also reducing manufacturing costs.

Figure 6:
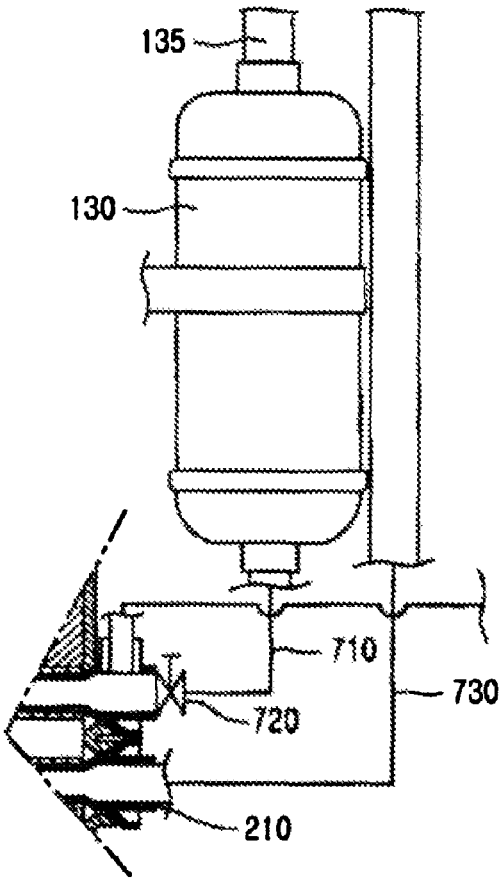
FIG. 6 is a sectional view showing a fourth embodiment in accordance with the present invention.

FIG. 6 is a sectional view showing a fourth embodiment according to the present invention.

Referring to FIG. 6, the first suction pipe is connected to the compression unit via the accumulator but the second suction pipe is directly connected to the compression unit without passing through the accumulator. Accordingly, it can be available to form one or more suction pipes to be directly connected to the compression unit without passing through the accumulator.

Figure 7:
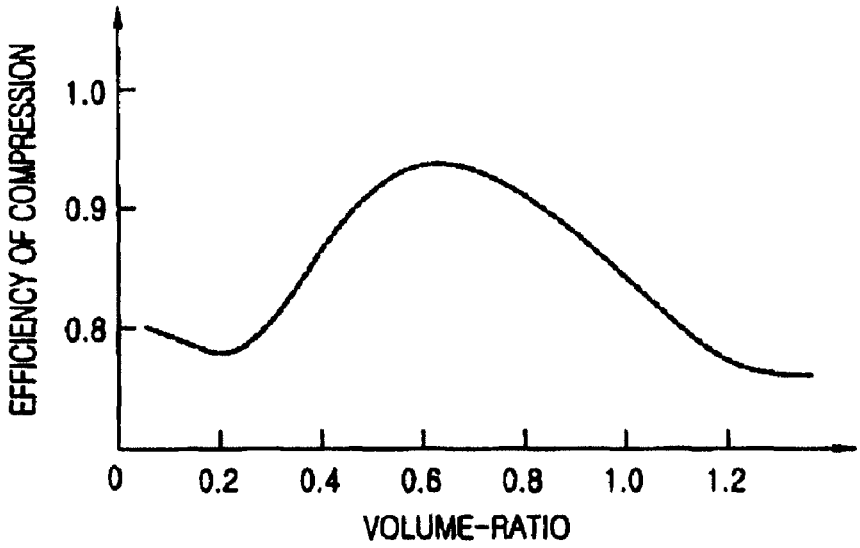
FIG. 7 is a graph showing a volume ratio of a cylinder and a compression efficiency according to the present invention.

FIG. 7 is a graph showing a compression efficiency based on a volume ratio of a cylinder in accordance with the present invention. In the graph, x-axis indicates a volume ratio obtained by dividing the volume of the first inner space of the first cylinder by the volume of the second inner space of the second cylinder, while y-axis indicates a compression efficiency. The compression efficiency refers to an efficiency factor having an influence by an inner gap leakage or a loss due to such as a loss of suction and discharge, a heat transfer, re-expansion, or the like.

With reference to FIG. 7, the volume ratio shows the highest compression efficiency at about 0.5~0.8.

Preferably, the volume ratio between the volume of the first inner space of the first cylinder and the volume of the second inner space of the second cylinder is 1:0.60~0.65.

INDUSTRIAL APPLICABILITY

As described so far, the multi-stage rotary compressor according to the present invention has effects as follows.

First, by re-compressing a previously-compressed refrigerant, a high discharge pressure can be obtained and a volume efficiency can be improved. Also, a leakage into a casing can be reduced and a heat quantity transferred to a low temperature refrigerant of a suction side can be remarkably decreased by using the previously-compressed refrigerant during the re-compression.

Second, the present invention does not need an additional component and a space to install it in comparison with a method in which a vane is moved back and fixed during a saving mode in process, thereby simplifying manufacturing processes. Also, because a piece for moving back and fixing the vane is not required, there can not be no problem related to abrasion, a generation of impurity, and the like, thereby improving reliability of the compressor.

Third, by using every plurality of compression units during the saving mode, efficiency of a motor or the compressor can be improved. Furthermore, compared with a power mode, since the previously-compressed refrigerant is re-compressed, power requirement becomes less, which results in a power saving effect.

Fourth, manufacturing costs can be reduced by varying capacity using a low price of a constant-speed motor.

The invention claimed is:

1. A multi-stage rotary compressor, comprising:

a casing having a sealed space therein;

a driving unit installed in the casing, for generating a driving force;

a first compression unit and a second compression unit for receiving the driving force from the driving unit and compressing a refrigerant; and a connection unit for selectively connecting the first compression unit to the second compression unit, wherein the connection unit comprises:

a first suction pipe for guiding the refrigerant to the first compression unit;

a second suction pipe for guiding the refrigerant to the second compression unit;

a chamber for covering an outlet of the second compression unit to store the refrigerant discharged from the second compression unit;

a first connection pipe connected to an outlet of the chamber;

a second connection pipe connected between the first connection pipe and the first suction pipe;

a third connection pipe connected between the first connection pipe and an inner space of the casing;

a first control valve mounted on the first suction pipe, for controlling the sucked refrigerant sucked into the first compression unit; and a second control valve mounted on a joint point of the first connection pipe, the second connection pipe, and the third connection pipe, for adjusting a flow direction of the refrigerant by guiding the refrigerant discharged from the chamber to be sucked into the first compression unit or to be discharged into the inner space of the casing.

2. The compressor of claim 1, wherein suction sides of the first and second suction pipes are connected to an accumulator separating gas-liquid of the refrigerant, respectively.

3. The compressor of claim 1, wherein the second control valve is a pilot valve.

4. The compressor of claim 1, wherein the driving unit is formed as a constant-speed motor.

5. The compressor of claim 1, wherein the first compression unit and the second compression unit have a different size of an inner space for sucking and compressing a compressed refrigerant, respectively.

6. The compressor of claim 5, wherein a volume ratio between the volume of the inner space of a cylinder of the second compression unit and the volume of the inner space of a cylinder of the first compression unit is 1:0.5~0.8.

7. The compressor of claim 6, wherein a volume ratio between the volume of the inner space of the cylinder of the second compression unit and the volume of the inner space of the cylinder of the first compression unit is 1:0.6~0.65.

8. The compressor of claim 1, wherein the first control valve and the second control valve are mounted on the outside of the casing.

* * * * *